US006247436B1

(12) United States Patent
Lancefield et al.

(10) Patent No.: US 6,247,436 B1
(45) Date of Patent: Jun. 19, 2001

(54) ENGINE FRONT COVER

(75) Inventors: Timothy Mark Lancefield, Bicester; Ian Methley, Witney, both of (GB)

(73) Assignee: Mechadyne PLC, Oxon (GB)

( * ) Notice: Subject to any disclaimer, the term of this patent is extended or adjusted under 35 U.S.C. 154(b) by 0 days.

(21) Appl. No.: 09/486,928

(22) PCT Filed: Sep. 25, 1998

(86) PCT No.: PCT/GB98/02910

§ 371 Date: Mar. 2, 2000

§ 102(e) Date: Mar. 2, 2000

(87) PCT Pub. No.: WO99/17002

PCT Pub. Date: Apr. 8, 1999

(30) Foreign Application Priority Data

Sep. 27, 1997 (GB) ..... 9720529

(51) Int. Cl.[7] ..... F01M 11/02; F02F 7/00; F01L 1/34; F01L 1/02; F01L 1/46

(52) U.S. Cl. ..... 123/90.38; 123/90.17; 123/195 C

(58) Field of Search ..... 123/90.15, 90.17, 123/90.31, 90.33, 90.38, 195 C, 198 E

(56) References Cited

U.S. PATENT DOCUMENTS

| | | | | |
|---|---|---|---|---|
| 5,301,639 | | 4/1994 | Satou | 123/90.17 |
| 5,474,038 | * | 12/1995 | Golovatai-Schmidt et al. | 123/90.17 |
| 5,566,651 | * | 10/1996 | Strauss et al. | 123/90.17 |
| 5,718,196 | * | 2/1998 | Uchiyama et al. | 123/195 C |
| 5,797,363 | * | 8/1998 | Nakamura | 123/90.17 |
| 5,842,451 | * | 12/1998 | Eisebeck et al. | 123/196 R |

FOREIGN PATENT DOCUMENTS

| | | |
|---|---|---|
| 196 47 299 | 4/1998 | (DE) . |
| 0 704 605 | 4/1996 | (EP) . |
| 0 863 297 | 9/1998 | (EP) . |

* cited by examiner

*Primary Examiner*—Weilun Lo
(74) *Attorney, Agent, or Firm*—Smith-Hill and Bedell

(57) ABSTRACT

An internal combustion engine is described having a crankshaft (14) and a camshaft, the ends of which project from a front end of the engine. A hydraulically operable variable valve actuation mechanism is mounted on the camshaft at the front end of the engine for driving the camshaft. A front cover (10) that overlies the end of the camshaft projecting from the front end of the engine, includes passages (40, 42) that are connected to supply oil under pressure from an engine driven pump (16) to the variable valve actuation mechanism.

6 Claims, 2 Drawing Sheets

ENGINE FRONT COVER

FIELD OF THE INVENTION

The present invention relates to a front cover for an internal combustion engine.

BACKGROUND OF THE INVENTION

The optimum angles at which the inlet and exhaust valves of an internal combustion engine should open and close, both in relation to one another and in relation to the engine crankshaft, and optimum valve lift all vary with the engine speed and load conditions. In an engine with fixed camshafts, a compromise setting must be adopted in which the different performance parameters are traded off one against the other.

To achieve performance improvements over a range of engine speeds and loads, it has already been proposed to vary the cam phase, duration, lift or a combination of these parameters in relation to the crankshaft by the introduction of variable valve actuation mechanisms.

Several variable valve actuation mechanisms are known from the prior art each having its own advantages and disadvantages. The majority of these mechanisms use oil pressure to control their operation via a control valve to which the oil is supplied by way of drillings in the camshaft and/or the cylinder head. A problem that is encountered with this approach is that the rate at which oil can be supplied to the control valve is restricted by the size of the drillings. Furthermore, there will be a drop in oil pressure due to the cylinder head being far removed from the oil pump in the case of many engines. Consequently, the variable valve actuation mechanism can only respond slowly when a change to its current setting is required.

A still further disadvantage is that the requirement for oil passages in the engine block, cylinder head and valve train can make it difficult to retro-fit the variable valve actuation mechanism into an existing engine.

EP-A-0,704,605 discloses an internal combustion engine having a crankshaft and a camshaft the ends of which project from a front end of the engine, a hydraulically operable variable valve actuation mechanism at the front end of the engine for driving the camshaft, an engine driven pump located at the front end of the engine and drive means located at the front end of the engine for transmitting torque from the crankshaft to the variable valve actuation mechanism. The engine is fitted with a front cover which covers the front end of the camshaft but does not reach down as far as the crankshaft nor the engine oil pump.

OBJECT OF THE INVENTION

The present invention accordingly seeks to provide a more convenient means of supplying oil under pressure to a hydraulic variable valve actuation mechanism, that achieves a more plentiful supply of oil under pressure and that can be retrofitted to some existing engines without major modification.

SUMMARY OF THE INVENTION

According to the present invention, there is provided an internal combustion engine having a crankshaft and a camshaft the ends of which project from a front end of the engine, a hydraulically operable variable valve actuation mechanism at the front end of the engine for driving the camshaft, an engine driven oil pump located at the front end of the engine and drive means located at the front end of the engine for transmitting torque from the crankshaft to the variable valve actuation mechanism, characterised by a front cover overlying the variable valve actuation mechanism, the end of the crankshaft projecting from the front end of the engine and the torque transmitting drive means, and by oil supply passages formed in the front cover and directly connected to the engine driven oil pump and to the variable valve actuation mechanism, to enable the resistance to oil flow of the hydraulic circuit connecting the engine drive oil pump to the variable valve actuation mechanism to be reduced.

In the present invention, oil is supplied to the variable valve actuation mechanism without the need for the oil to flow through the drillings in the camshaft. The oil passages in the front cover can therefore be sized as required and no restriction is placed on them by such considerations as the diameter of the camshaft and the dimensions of the camshaft bearings. Furthermore, because few modifications are required in the engine block, cylinder head and valve train, the invention allows variable valve actuation to be retrofitted to existing engines.

An engine driven oil pump can conveniently be located either at the front end of the engine or within the engine cover, allowing a relatively short passage of large diameter to be mounted on, or formed in, the front cover to transfer oil from the engine pump to the variable valve actuation mechanism. Hence, a large oil flow rate can readily be established and there will not be a serious drop in the pressure in the oil reaching the valve actuation mechanism.

It is also preferred that the cover should incorporate a regulating valve for controlling the oil supply to the valve actuation mechanism.

The actuation mechanism may include a cylindrical working chamber mounted for the rotation with the engine camshaft and the front cover may include an end closure for the working chamber sealed against the cylindrical wall of the chamber by means of rotary seals. As an alternative to rotary seals, the passages in the cover may communicate with short large diameter bores formed in the engine block or cylinder head and connected directly to the variable valve actuation mechanism without passing through drillings in camshaft.

It will be appreciated that the invention is not restricted to any particular valve actuation mechanism and may be used with any mechanism that is hydraulically operated.

In a further development of the invention, a water pump may be mounted on the engine front cover and driven by a pulley mounted on the crankshaft. The coolant circuit of the water pump may in this case comprise further passages formed in the front cover and connecting the water pump to coolant galleries in the engine block and/or the engine cylinder head.

BRIEF DESCRIPTION OF THE DRAWINGS

The invention will now be described further, by way of example, with reference to the accompanying drawings, in which.

DESCRIPTION OF THE PREFERRED EMBODIMENT

Figure 1:
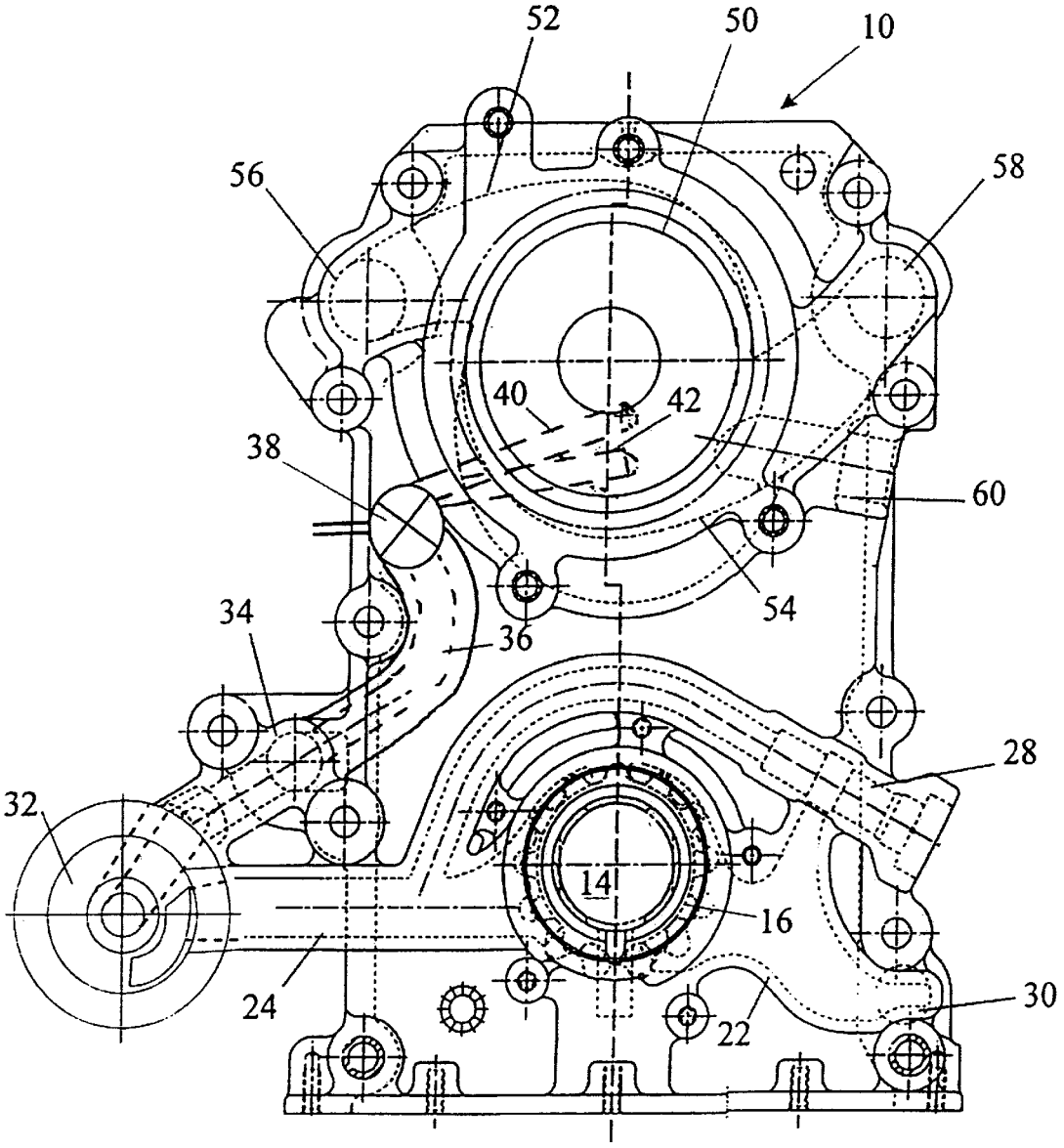
FIG. 1 is a front elevation of an engine front cover.

The engine front cover 10 shown in the drawings is designed to fit over the front end of an engine. The engine camshaft is driven by a sprocket that incorporates a hydraulically operated variable valve actuation mechanism which in turn is driven by a chain passing over a sprocket mounted on the front end of the crankshaft. The engine front cover 10 encloses the chain, the variable valve actuation mechanism and the sprockets and seals against the engine block and cylinder head to allow oil lubrication of the chain and sprockets.

Conventionally, the oil supply to the variable valve actuation mechanism would be effected through drillings in the camshaft but the limited size of such drillings prevents rapid fluid flow rates and reduces the pressure at the variable valve actuation mechanism. In the present invention, oil is supplied to the variable valve actuation mechanism from the front cover to reduce these constraints. This allows large diameter passages with minimal flow resistance to be used to convey the oil to the hydraulics of the variable valve actuation mechanism.

Figure 2:
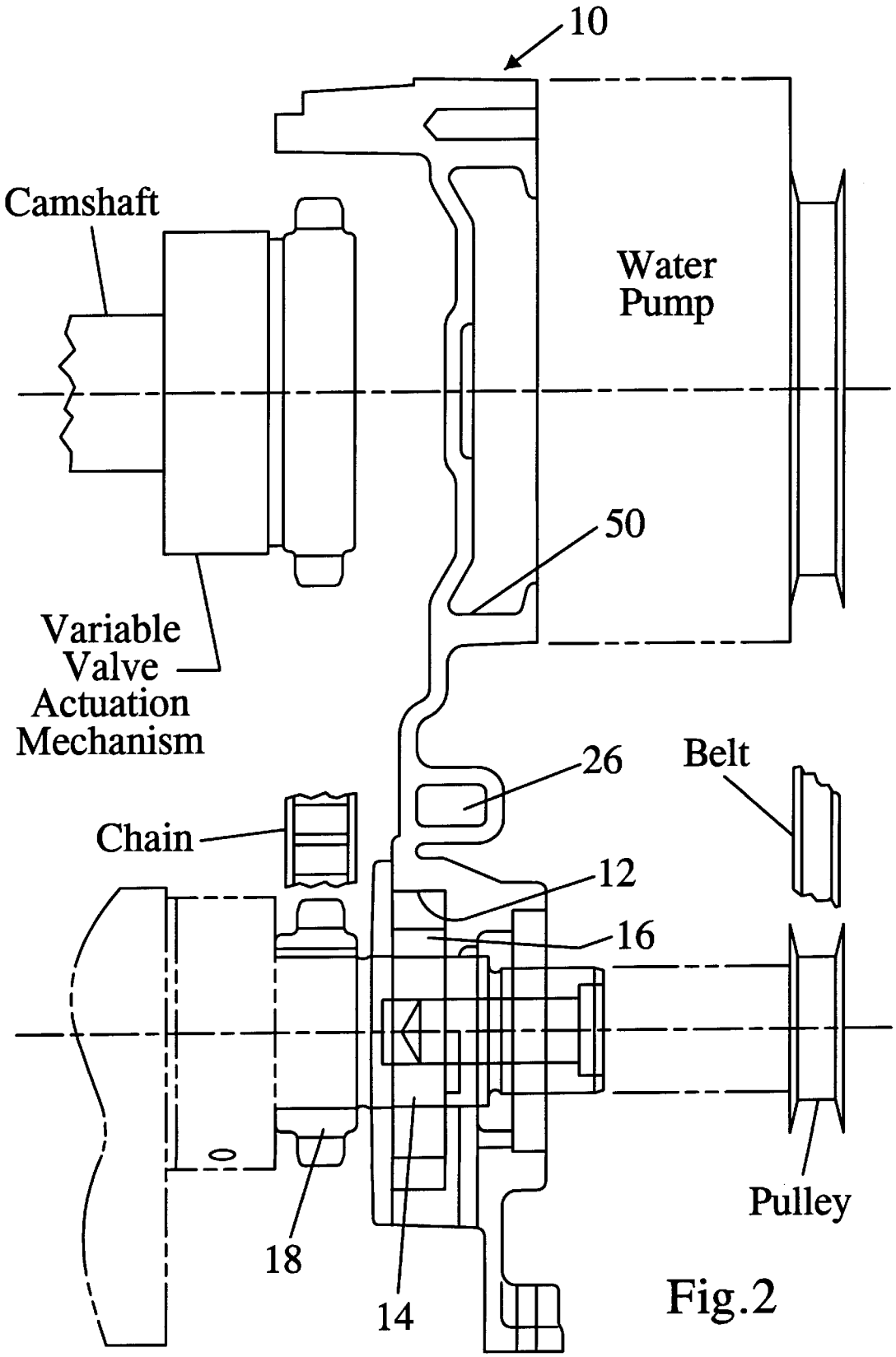
FIG. 2 is a vertical section through the front cover of FIG. 1.

FIG. 2 shows a variable valve actuation mechanism as it is known per se and the invention can be applied to any such mechanism that is hydraulically operated. Typically, such a mechanism may comprise a piston that is movable axially with respect to the camshaft and coupled to a mechanical linkage that converts the axial movement of the piston into an angular displacement of the drive sprocket relative to the camshaft.

In one embodiment of the invention, the actuation mechanism may have a chamber rotating with the mechanism and in fluid communication with oil passages in the front cover, rotary seals being used to seal between the rotating actuation mechanism and the stationary engine front cover.

Alternatively, the oil passages may enter the engine block to supply oil through short large diameter bores formed in the engine block near the variable valve actuation mechanism. The illustrated embodiment of the invention adopts the latter approach.

Referring now to FIG. 2, the illustrated engine front cover 10 has an aperture 12 through which projects the front end of the crankshaft 14. An oil pump 16 driven by the engine crankshaft 14 is located within the aperture 12 and seals between the crankshaft 14 and the engine front cover 10. FIG. 2 also shows the sprocket 18 on the crankshaft that drives the camshaft through a chain.

The illustrated oil pump 16 is a gear pump that draws engine oil from a low pressure passage 22 shown to the right of the crankshaft 14 in FIG. 1 and delivers it to high pressure passage 24. The various passages are shown in FIG. 1 in dotted lines. A bypass passage 26 containing a pressure relief valve 28 passes in a semi-circle above the oil pump 16 and connects the high pressure passage 24 to the low pressure passage 22. The pressure relief valve 28 is not shown in detail but is generally conventional. In particular it comprises a spring biased valve spool which opens the bypass passage 26 to short circuit the oil pump 16 when the oil supply pressure exceeds a safe limit.

The low pressure passage 22 is connected through a bore 30 in the engine block to draw oil from the oil pump. The high pressure passage 24, on the other hand leads to an oil filter adapter 32 onto which an oil filter canister (not shown) is screwed. Filtered oil flows by way of a passage 36 in the front cover 10 into the engine block through a bore 34 and also flows by way of a continuation of the passage 36 to a solenoid operated control valve 38. The control valve 38 is mounted in the engine front cover and controls the flow in lines 40 and 42 that are connected through bores in the engine block and/or cylinder head to the variable valve actuation mechanism. One of the lines 40 and 42 acts as a supply line and the other as a return line, depending on the direction of movement of the actuation mechanism. Oil can in this way be supplied at a high rate to the variable valve actuation mechanism through the solenoid operated control valve 38 and return oil from the mechanism is discharged into the chamber defined between the engine and the engine front cover 10 to assist in the lubrication of the sprockets and the drive chain. Oil from this chamber drains back into the engine sump through a suitably positioned drainage hole.

The front cover 10 in the illustrated embodiment not only has oil passages that forms part of the lubricating circuit of the engine but also has water passages that form part of the coolant circuit. A circular recess 50 is provided on the cuter face of the end cover 10 to receive a water pump housing that is driven by a belt from a pulley mounted on the crankshaft 14. The water pump communicates through passages 52, 54 in the engine cover 10 with coolant galleries 56 and 58 formed in the engine block and/or cylinder head. The pump also communicates by way of a connector 60 and a flexible hose with the radiator.

What is claimed is:

1. An internal combustion engine having a crankshaft (14) and a camshaft the ends of which project from a front end of the engine, a hydraulically operable variable valve actuation mechanism at the front end of the engine for driving the camshaft, an engine driven oil pump (16) located at the front end of the engine and drive means located at the front end of the engine for transmitting torque from the crankshaft to the variable valve actuation mechanism, characterised by a front cover (10) overlying the variable valve actuation mechanism, the end of the crankshaft projecting from the front end of the engine and the torque transmitting drive means, and by oil supply passages (40, 42) formed in the front cover (10) and directly connected to the engine driven oil pump (16) and to the variable valve actuation mechanism, to enable the resistance to oil flow of the hydraulic circuit connecting the engine driven oil pump (16) to the variable valve actuation mechanism to be reduced.

2. An engine as claimed in claim 1, wherein the engine driven oil pump (16) is mounted on the engine front cover (10).

3. An engine as claimed in claim 1, wherein the drive means is a chain and the front cover seals against the front end of the engine to allow the chain to be oil lubricated.

4. An engine as claimed in claim 1, wherein the engine front cover (10) incorporates a control valve (38) for controlling the oil supply to the valve actuation mechanism.

5. An engine as claimed in claim 1, wherein a water pump is mounted in a recess (50) in the engine front cover (10) and is driven by a pulley mounted on the crankshaft.

6. An engine as claimed in claim 5, wherein the coolant circuit of the water pump comprises further passages (52, 54) formed in the front cover (10) and connecting the water pump to coolant galleries (56, 58) in the engine block and/or the engine cylinder head.

* * * * *